United States Patent [19]

Ward

[11] 4,269,007

[45] * May 26, 1981

[54] VENT AND BAFFLES

[75] Inventor: Bruce K. Ward, St. Louis Park, Minn.

[73] Assignee: Insulation Sales Co., Minneapolis, Minn.

[ * ] Notice: The portion of the term of this patent subsequent to Nov. 21, 1995, has been disclaimed.

[21] Appl. No.: 32,879

[22] Filed: Apr. 24, 1979

Related U.S. Application Data

[60] Division of Ser. No. 896,890, Apr. 17, 1978, which is a continuation-in-part of Ser. No. 834,322, Sep. 19, 1977, Pat. No. 4,125,971.

[51] Int. Cl.[3] ..... E04B 7/02

[52] U.S. Cl. ..... 52/92; 52/95; 52/199

[58] Field of Search ..... 52/95

[56] References Cited

U.S. PATENT DOCUMENTS 4,125,971 11/1978 Ward ..... 52/95 X

*Primary Examiner*—Price C. Faw, Jr.
*Assistant Examiner*—Carl D. Friedman
*Attorney, Agent, or Firm*—Dorsey, Windhorst, Hannaford, Whitney & Halladay

[57] ABSTRACT

A vent and baffle used to provide an air passage between the soffit and the attic of a house to insure the flow of air through the attic. The vent is an elongated arcuate member having outwardly directed flanges adapted to be secured to the roof boards of a structure with suitable fasteners. A first baffle is a block having a semi-circular recess to accommodate and support the one end of the vent againt the roof boards. The baffle is located in a tight fit or wedged relationship with the roof boards, adjacent roof rafters, and top plate of the structure to block the passage below the vent between the attic and the soffit and insulate the area above the top plate of the side wall of the structure. A second baffle is used without the vent to block the entire space above the top plate between adjacent roof rafters. The vent and baffles are made from a foamed plastic having flame resistant additives.

18 Claims, 12 Drawing Figures

VENT AND BAFFLES

This application is a division of Ser. No. 896,890, filed Apr. 17, 1978 which is a continuation in part of Ser. No. 834,322 filed Sept. 19, 1977 now U.S. Pat. No. 4,125,971.

BACKGROUND OF THE INVENTION

Vent structures are used to provide air passages between the soffit and the attic of a structure to insure the flow of air through the attic to remove hot air and moisture from the attic. When the air passages and soffit of a structure, such as a home, is blocked with insulation or air flow impeding material inadequate attic ventilation results. This causes condensation of moisture in the attic, which accumulates in the attic insulation material. This reduces the insulating effectiveness of the insulating material and may cause damage to the interior of the structure. Inadequate insulation in the attic also results in heat loss in the winter and cool air losses in the summer.

The increased cost of fuel has caused an increased use of insulation materials in the attics of structures. Fiber and foam plastic insulation materials are blown into the crawl or attic space below the roof and between the ceiling joists. Matt-type insulation material is also used. Poor air circulation can result when the spaces between the roof joists and the top wall plate are closed, as these spaces provide the air passages between the soffit and attic.

SUMMARY OF THE INVENTION

The invention is directed to a vent and baffle usable to provide an air passage between the soffit and the attic of a structure, to prevent insulating material from accumulating and blocking the soffit area, and insulate the space above the top wall plate. The vent is a generally elongated member having an arcuate cross section and laterally and outwardly directed side flanges. The flanges are adapted to be located in surface engagement with the roof boards of a structure and are adapted to receive fasteners, such as staples, nails, and the like for attaching the vent to the roof boards. The baffle has a generally U-shaped top recess to accommodate the lower end of the vent. The baffle has a bottom surface and tapered side surface. The shape and size of the baffle is such that it has a wedge fit between adjacent ceiling joist and roof rafter, and between the top wall plate and roof boards of a structure. The baffle blocks or closes the passage below the vent between the attic and the soffit, and thereby prevents the movement of insulating material from the attic into the soffit. The baffle has an enlarged center portion having opposite sides which can be conveniently gripped by an installer to facilitate the placement of the baffle between adjacent ceiling joists above the top plate of the side wall. The vent and baffle are preferably made of a foam plastic, as polystyrene, polyurethane, and the like.

The vent and baffle is an effective conserver of heat energy. The vent allows additional insulation to be placed adjacent the wall plate and above the ceiling. The baffle in conjunction with the vent prevents the blow back of insulation due to high winds blowing air through the soffit vents. The baffle is used adjacent the outside edge of the top wall plate resulting in greater insulation efficiency above the wall plate. The air passage through the vent allows air to flow to the attic so that condensation moisture is not collected by the insulation in the attic. The result is that the insulation does not get wet and does not compact. The flow of air through the attic reduces summer heat and, therefore, reduces air conditioning costs. The vent and baffle can be installed with minimum time and labor and is made of low-cost high-temperature insulating materials.

A second or blocking baffle is used to close the space above the top wall plate between adjacent ceiling joist and roof rafter to prevent insulation from being placed in the soffit area of the structure. The blocking baffle has a bottom surface and forwardly tapering side surfaces and a downwardly tapered top surface. The blocking baffle is of a size to wedge fit between an adjacent ceiling joist and roof rafter, the top wall plate, and the roof boards of the structure. The blocking baffle has an enlarged center portion with upright opposite sides which can be conveniently gripped by the installer or an installation tool to facilitate the placement of the blocking baffle on the top wall plate to close the passage between the soffit and the attic. The blocking baffle is preferably made of a foam plastic, as polystyrene, polyurethane, and the like.

These and other advantages of the vent and baffle structure are embodied in the following detailed embodiment of the vent and baffle structure. It is intended that modifications and changes in the size and shapes of the structures can be made by those skilled in the art without departing from the invention.

DESCRIPTION OF PREFERRED EMBODIMENT

Figure 1:
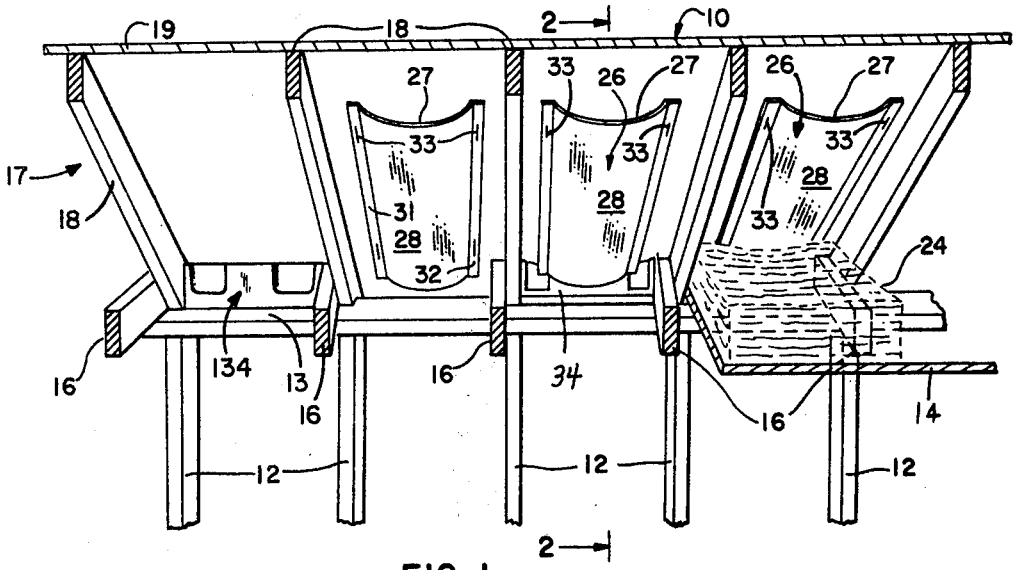
FIG. 1 is a vertical sectional view of a structure equipped with the vent and vent baffle of the invention.
Figure 2:
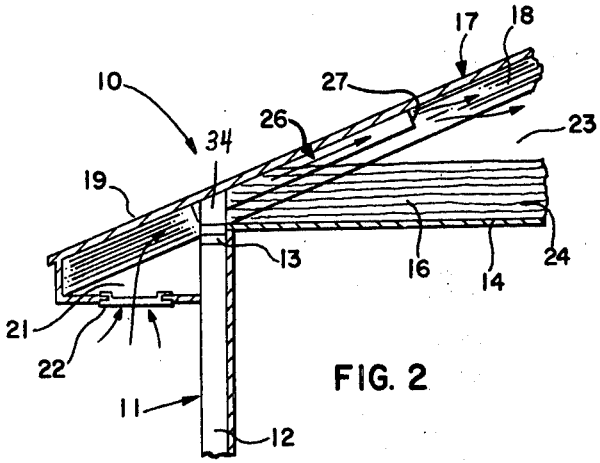
FIG. 2 is a sectional view taken along the line 2—2 of FIG. 1.

Referring to FIGS. 1 and 2, there is shown part of the structure, as a house or shelter, having an upright side wall. The side wall contains a plurality of upright wall studs 12 supporting a top plate 13. The top plate 13 supports a ceiling 14. A plurality of laterally spaced horizontal ceiling joists 16 rest on top of plate 13 and form the supports for the ceiling. Wall studs 12 and ceiling 14 are covered with a roof 17. The roof 17 has upwardly extended rafters 18 carrying a roof cover 19, as boards, panels, or plywood sheets. The suitable protective structure, such as shingles, tiles, and the like are supported on roof boards 19. As shown in FIG. 2, roof 17 has an outwardly directed overhang defining a soffit area 21. A plurality of air vents 22 insures a flow of outside air into soffit 21. It is desirable that sufficient air moves through the soffit area and the attic to reduce the moisture and temperature of air in the attic.

Insulation material 24 is located in the attic to minimize the flow of heat through the ceiling. In the winter months insulation 16 minimizes the flow of heat upwardly through the ceiling 14. In the summer months insulation 16 minimizes the flow of the hot air in attic space 13 to ceiling 14. The insulation can be a matt material, fibrous material, vermiculite, foamed plastic materials, and the like.

The vent and baffle of the invention indicated generally at 26 located between adjacent ceiling joist 16 and roof rafters 18 provides an air passage 27 leading from soffit 21 to the attic 23. Air passage 27 insures continuous flow of air from soffit 21 through attic 23. Vent and baffle 26 can be placed in between all of the adjacent roof rafters of the structure. Alternatively, the vent and baffle can be used in alternate or selected positions to insure the proper flow of air from the soffit into the attic. As shown in FIG. 1, a blocking baffle indicated generally at 134 is used to close the space between the soffit and the attic when the vent is not used. Blocking baffle 134 permits the insulation to be banked up to the roof boards at any desired height without the insulation flowing into the soffit.

Figure 3:
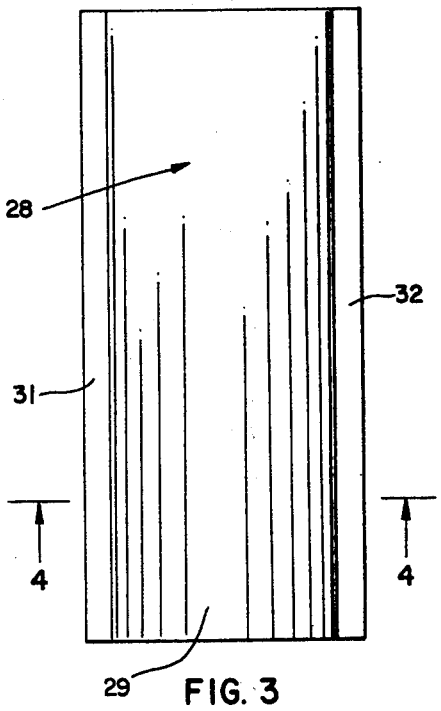
FIG. 3 is a top plan view of the vent.
Figure 4:
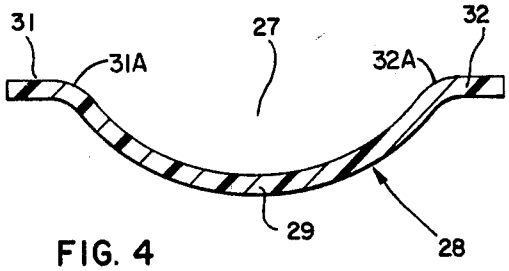
FIG. 4 is an enlarged sectional view taken along the line 4—4 of FIG. 3.

Referring to FIGS. 3 and 4, the vent indicated generally at 28 has an elongated body 29 having a longitudinal recess or groove forming passage 27. Body 29 has an arcuate cross section providing passage 27 with a uniform size throughout the length of body 29. A first outwardly directed flat flange 31 is integral with one edge of body 29. A similar flat outwardly directed flange 32 is integral with the opposite side of body 29. As shown in FIG. 4, flanges 31 and 32 are integral with the opposite longitudinal side edges of body 29. The juncture between flanges 31 and 32 and body 29 is arcuate or curved longitudinal sections 31A and 32A.

Vent 28 is made of structural material, as wood, sheet metal, cardboard, sheet plastic and foamed plastic. In one form, vent 28 is a one piece foam plastic, as polystyrene with a flame resistant material. Suitable flame resistant materials, as trisphosphate, hexabromocyclododecone, and the like can be added to the polystyrene foam. Vent 28 can be made from polyurethane or polyolefin foam having flame resistant additives or coatings. Examples of suitable materials are disclosed in U.S. Pat. Nos. 3,108,016 and 3,663,463.

The vent has a length of 90 cm and width of 30 cm. The flanges have a width of 3 cm and extend the full length of the body 29. The passage has a maximum depth of 8 cm. The body and flanges have a thickness of about 1 to 1.5 cm. Other sizes can be used to form vent 28.

As shown in FIG. 1, flanges 31 and 32 are positioned in flat surface engagement with the inside surface of the roof boards 19 between adjacent roof rafters 18. Fasteners 33, as staples, nails and the like cooperate with the flanges 31 and 32 to secure the vent 28 to the roof boards. Vent 28 is positioned adjacent top plate 13 and functions as a barrier to prevent the insulation 24 from blocking the air passage 27 from the soffit 21 to attic 23. Vent 28 can be used without baffle 34 to provide a passage 27 between soffit 21 and attic 23. Vent 28, shown in the left side of FIG. 1, is used without vent baffle 34.

Referring to FIGS. 5-8 , the baffle indicated generally at 34 has a solid upright back 36. The back 36 is integral with the bottom or base 37 having a flat lower surface adapted to be located in firm surface engagement with top plate 13 between adjacent ceiling joist 16 and roof rafter 18. The opposite sides 38 and 39 of the back 36 extend in an upward direction and have flat outside surfaces. Sides 38 and 39 taper in a forward direction to guide and facilitate the insertion of baffle 34 between the adjacent ceiling joist 16 and roof rafter 18, top plate 13, and roof boards 19. The rear portions 38A and 39A of sides 38 and 39 are flat non-tapering surfaces that wedge fit between the adjacent ceiling joist and roof rafter.

The top of body 36 has an arcuate recess 41 and outwardly directed side pockets 42 and 43. Recess 41 and side pockets 42 and 43 have substantially the same curvature and shape as vent body 29 and flanges 31 and 32 of vent 28. The depth of pockets 42 and 43 is substantially the thickness of flanges 31 and 32. The lower end of vent 28 fits into recess 41 with the flanges 31 and 32 located in the pockets 42 and 43. Pockets 42 and 43 have a depth slightly less than the thickness of flanges 31 and 32 of vent 28. This enables baffle 34 to force flanges 31 and 32 into engagement with roof boards 19.

Figure 8:
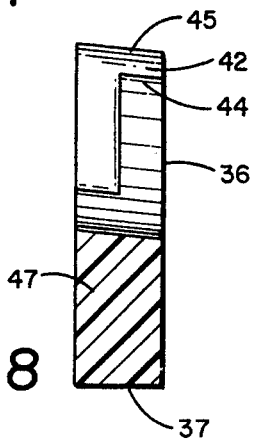
FIG. 8 is a sectional view taken along the line 8—8 of FIG. 5.

As shown in FIG. 8, the top portion 44 of wall 36 and recess surface 44 is inclined outwardly or forwardly so that it holds flange 31 of the vent in firm engagement with roof boards 19. The top portion of body 36 adjacent pocket 43 has a similar inclination to hold the flange 32 in firm engagement with roof boards 19.

The opposite outer sections of body 36 have inclined top surfaces 45 and 46 adapted to fit into tight engagement with roof boards 19. As shown in FIG. 8, surface 45 is inclined outwardly to accommodate the inclination or slope of roof boards 19. The top surfaces 45 and 46 engage the roof boards, while the bottom surface 37 is in firm and tight engagement with the top of plate 13 whereby baffle 34 is located in a tight friction fit relationship in the space between top plate 13 and roof boards 19.

Figure 6:
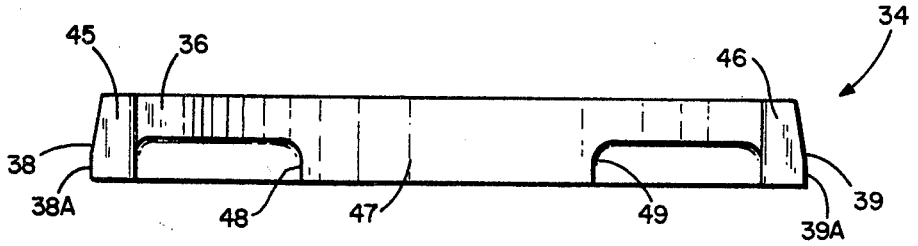
FIG. 6 is a top plan view of FIG. 5.
Figure 5:
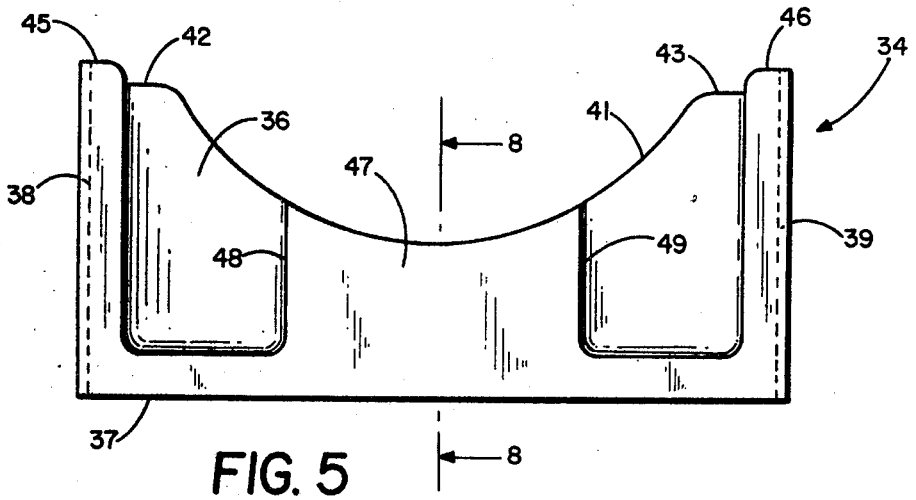
FIG. 5 is a front elevational view of the inside of the vent baffle.
Figure 7:
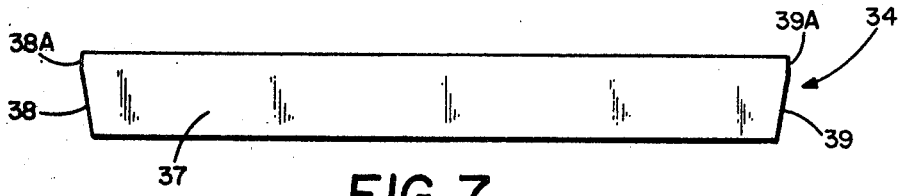
FIG. 7 is a bottom plan view of FIG. 5.

As shown in FIGS. 5, 6 and 8, the center of the back 36 has a central web 47. Web 47 has opposite upright sides 48 and 49. The web 47 is an enlarged central portion of the back 46 which increases the strength of the back 36 and provides a means for gripping the baffle 34 so that it can be readily placed above the top plate.

In one form, baffle 34 is a one piece foam plastic, as polystyrene with suitable flame retardants. The baffle has a width of 34 cm, a height of 15 cm, and a thickness of 4 cm. Other sizes and dimensions can be used to form the baffle.

In use, the vent and baffle, as shown in FIG. 1, is located between adjacent ceiling joist 16 and roof rafter 18 to provide an air passage 27 between soffit area 21 and attic space 23. Vent 28 is located adjacent the roof boards 19. Flanges 31 and 32 rest on the inside surface of the roof boards 19 and can be attached thereto with fasteners 33. The lower end of vent 28 is located adjacent the top plate 13. In some installations, vent 26 can extend down into soffit area 21. Baffle 34 cradles around the lower end of vent 28 to block the passage between the soffit and the attic, except for vent passage 27. Baffle 34 also functions as a barrier to prevent the movement of the insulation 24 from the attic into soffit 21. The lower flat side 37 of the baffle bears against the top of top plate 13. The top inclined surfaces 45 and 46 of the baffle are in firm engagement with the inside of the roof cover 19 whereby the baffle 34 is wedged between top plate 13 and roof boards 19. The tapered sides 38 and 39 are in firm engagement with the facing sides of a roof rafter 18 and ceiling joist 16. The web 47 is used by the installer to position the baffle 34 in the space above top plate 13. The side surfaces 48 and 49 provide convenient means for the thumb and fingers of the installer to manipulate and force the baffle 34 into its proper position. Special installing tools can be used to properly locate the baffle 34 in its position above top plate 13.

FIG. 1 also shows the vent 28 being used between adjacent roof rafters 18 without the baffle. A plurality of fasteners 33, as staples, nails and the like extend through the flanges 31 and 32 to attach the vent 28 to the roof boards. The vent provides the air passage 27 from adjacent the soffit area to the attic.

The vent 28 and baffle 34 are constructed of foam material, as expanded polystyrene, having flame-retardant characteristics. Other types of foamed plastic materials can be used for the vent and baffle. Also, the vent and baffle can be made of structural materials, such as wood, sheet metal, cardboard, masonite, hardboard, and like materials.

Referring to FIGS. 9–12, a blocking baffle 134 has a solid upright back or body 136. Body 136 has a flat bottom or base 137 adapted to be located in surface engagement with top plate 13 between the adjacent ceiling joist 16 and roof rafter 18. Body 136 has opposite upright sides 138 and 139 that taper in a forward direction to facilitate the insertion of the blocking baffle 134 between the ceiling joist 16 and adjacent roof rafter 18. The tapered sides 138 and 139 serve as centering and guide surfaces during the installation of the blocking baffle 134. Body 136 has a flat top surface or top 141 inclined downwardly in a forward direction. The inclination of top 141 is about the same as the slope or inclination of roof boards 19.

Figure 9:
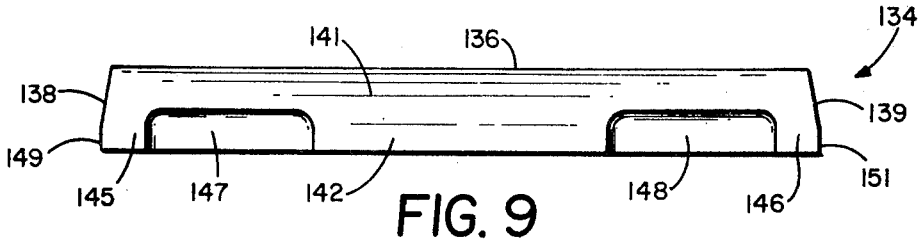
FIG. 9 is a top plan view of the blocking baffle.
Figure 10:
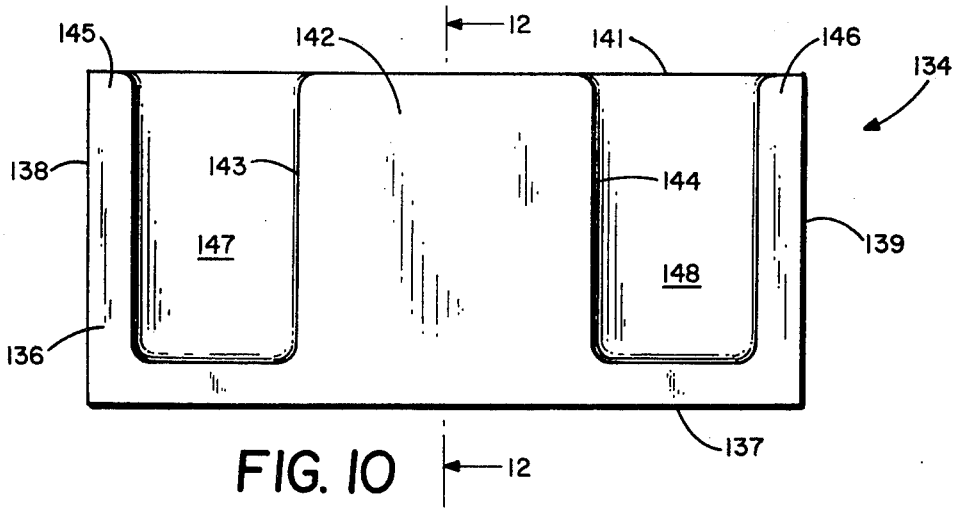
FIG. 10 is a front elevational view of the inside of the blocking baffle.
Figure 11:
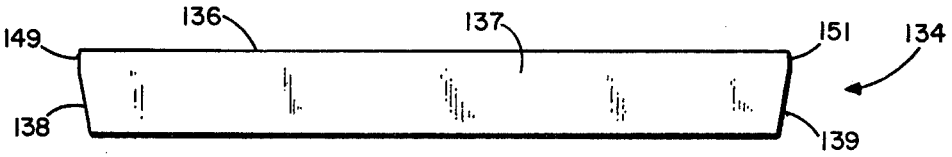
FIG. 11 is a bottom plan view of FIG. 10.
Figure 12:
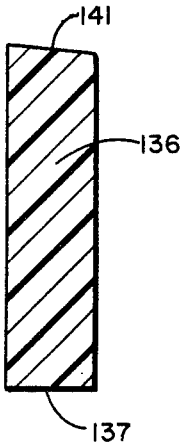
FIG. 12 is a sectional view taken along the line 12—12 of FIG. 10.

As shown in FIGS. 9 and 10, the center of the body 136 has an upright central web 142. Web 142 has opposite upright sides 143 and 144. Web 142 increases the strength of the middle section of body 136. Sides 143 and 144 provide a means for gripping body 136 so that it can be placed in position above top plate 13, as shown in FIG. 1. Web 142 provides a body or mass for holding a tool used to place blocking baffle 134 in a tight wedge fit position between ceiling joist 16 and adjacent roof rafter 18.

The opposite sides of body 136 have rearwardly directed upright side flanges 144 and 146. Flanges 144 and 146 form with the central web 142 upright recesses 147 and 148 in the rear side of the body. Flange 144 has a flat non-tapered outside edge 149 that merges with the tapered side 138. Flange 146 has a flat non-tapered outside edge 151 that merges with the tapered side 139. The edges 149 and 151 provide flat surfaces that are wedged in the tight relationship with the adjacent ceiling joist 16 and roof rafter 18.

In use, blocking baffle 134, as shown on the left side of FIG. 1, fits into the space above plate 13 to block the passage between the soffit and the attic. The tapered sides 138 and 139 serve to locate and guide the blocking baffle 134 into position above plate 13. The bottom 137 is located on top of plate 13. The top tapered surface 141 is wedged into a tight relationship with the bottom of roof boards 19. Blocking baffle 134 is wedged into position and retained there in a tight frictional relationship with the ceiling joist 16, roof rafter 18, top plate 13, and roof boards 19. Block baffle 134 is made of a one piece foam plastic, as polystyrene, polyurethane, and the like. The foam plastic can be provided with suitable flame retardants. Blocking baffle 134 can have different lengths to accommodate different width ceiling joists and roof rafters. Blocking baffle 134 can be made of other structural materials, as wood, sheet metal, cardboard, masonite, hard board, and like structural materials.

While there has been shown and described an embodiment of the vent and baffle and blocking baffle, it is understood that changes in the cross sectional shapes of the vent and baffles can be made without departing from the invention. The invention is defined in the following claims.

The embodiments of the invention in which an exclusive property or privilege is claimed are defined as follows:

1. A vent and baffle for providing an air passage between the soffit and attic of a structure having a top wall plate, roof rafters, ceiling joists, and a roof cover secured to the roof rafters comprising:

a vent having an elongated body, said body having opposite longitudinal sides and an arcuate shaped cross section forming a longitudinal groove with open ends, and outwardly directed side flanges secured to and extended along said opposite sides of the body;

a baffle having a top arcuate recess and side pockets for accommodating a transverse portion of the body and side flanges, said baffle having a bottom portion engageable with the top wall plate whereby the baffle holds the side flanges of the vent in engagement with the roof cover so that the groove of the body forms with the roof cover an air passage between the soffit and attic.

2. The vent and baffle of claim 1 wherein:

the vent and baffle are made of foamed plastic.

3. The vent and baffle of claim 1 wherein:

said baffle has sides engageable with a roof rafter and a ceiling joist to block the space between the soffit and attic except for the air passage formed by the body.

4. The vent and baffle of claim 3 wherein:

said baffle has a center web with side surfaces usable to facilitate the placement of the baffle between an adjacent roof rafter and ceiling joist.

5. A vent and baffle for providing an air passage between the soffit and attic of a structure having a top wall plate, roof rafters, ceiling joists, and a roof cover attached to the roof rafters comprising:

a vent having an elongated body having opposite sides and a longitudinal groove forming an air passage, a baffle having a recess of a size and shape to accommodate a transverse portion of the body of the vent, said baffle having a bottom section engageable with the top wall plate whereby the baffle holds the vent in engagement with the roof cover so that the groove in the body of the vent forms with the roof cover an air passage between the soffit and the attic.

6. The vent and baffle of claim 5 wherein:

the vent has outwardly directed side flanges extending along opposite sides of the body, said baffle having side pockets on opposite sides of the recess for accommodating the side flanges whereby the baffle holds the side flanges in engagement with the roof cover.

7. The vent and baffle of claim 5 wherein:

said baffle has a center web with side surfaces usable to facilitate the placement of the baffle between an adjacent roof rafter and ceiling joist.

8. The vent and baffle of claim 5 wherein:

said baffle has upright sides engageable with the facing upright sides of a roof rafter and a ceiling joist to block the space between the soffit and the attic except for the air passage formed by the vent, said baffle having a flat bottom surface extended substantially normal to the sides engageable with the top of the wall plate.

9. The vent and baffle of claim 8 wherein:

said baffle having an upright center web with side surfaces usable to facilitate the placement of the baffle between the adjacent roof rafter and ceiling joists and the top wall plate and ceiling cover.

10. The vent and baffle of claim 8 wherein:

the vent and the baffle are made of foam plastic.

11. A baffle usable with a vent having a longitudinal groove for providing an air passage between the soffit and attic of a structure having a top wall plate, roof rafters, ceiling joists, and a roof cover attached to the roof rafters comprising:

a body having a bottom portion engageable with the top wall plate, opposite sides adapted to engage facing portions of a roof rafter and a ceiling joist, and a top portion having a recess of a size and shape to accommodate a transverse portion of the vent to hold the vent in engagement with the roof cover so the groove forms with the roof cover an air passage between the soffit and attic.

12. The baffle of claim 11 wherein:

said body has a center web with side surfaces usable to facilitate the placement of the baffle between an adjacent roof rafter and ceiling joist.

13. The baffle of claim 11 wherein:

the top recess has a concave arcuate shape.

14. The baffle of claim 13 including:

pockets in said top portion open to said recess to accommodate portions of the vent.

15. The baffle of claim 11 including:

at least one pocket in said top portion open to the recess to accommodate a portion of the vent.

16. A baffle for closing the air passage between the soffit and attic of a structure having a top wall plate, roof rafters, ceiling joists, and a roof cover attached to the roof rafters comprising:

a body having a bottom portion adapted to engage the top wall plate, opposite sides adapted to engage facing portions of a roof rafter and a ceiling joist, and a top portion adapter to engage the roof cover.

17. The baffle of claim 16 wherein:

the top portion has an inclined top surface adapted to engage the roof cover.

18. The baffle of claim 16 wherein:

said body has a center web with side surfaces usable to facilitate the placement of the baffle between an adjacent roof rafter and ceiling joist.

* * * * *